US005102406A

United States Patent [19]

Arnold

[11] Patent Number: 5,102,406

[45] Date of Patent: Apr. 7, 1992

[54] DEVICE AND METHOD FOR AVOIDING CONTAMINATION OF MULTI-DOSE MEDICAMENT VIALS

[76] Inventor: Victor A. Arnold, 3715 N. 12th Pl., Phoenix, Ariz. 85014

[21] Appl. No.: 649,967

[22] Filed: Feb. 4, 1991

Related U.S. Application Data

[63] Continuation of Ser. No. 360,299, Jun. 2, 1989, abandoned.

[51] Int. Cl.[5] ..... A61B 19/00

[52] U.S. Cl. ..... 604/405; 604/126; 604/199

[58] Field of Search ..... 604/122, 126, 199, 403, 604/405, 415; 55/159, 385.4, 519

[56] References Cited

U.S. PATENT DOCUMENTS

| | | | |
|---|---|---|---|
| 1,967,439 | 7/1934 | Heineman | 604/415 |
| 2,879,766 | 3/1959 | Wilburn | 604/199 X |
| 3,157,481 | 11/1964 | Bujan | 604/122 X |
| 4,154,342 | 5/1979 | Wallace | 206/439 |
| 4,769,026 | 9/1988 | Strung | 604/415 |
| 4,872,872 | 10/1989 | Polak | 604/405 |

*Primary Examiner*—C. Fred Rosenbaum
*Assistant Examiner*—C. Maglione
*Attorney, Agent, or Firm*—Mortenson & Uebler

[57] ABSTRACT

The disclosure of this application is directed to a clean air tube which provides a constantly renewable source of purified air for loading into a medicament syringe prior to use of the syringe for withdrawing liquid medicament from a multi-dose vial. The tube is fitted with a clean-filtering membrane, through which ambient air is filtered upon being drawn into the tube. The disclosure also describes the sequence of steps involved in loading the syringe with clean-filtered air.

10 Claims, 1 Drawing Sheet

DEVICE AND METHOD FOR AVOIDING CONTAMINATION OF MULTI-DOSE MEDICAMENT VIALS

CROSS-REFERENCE TO RELATED APPLICATION

This application is a continuation of prior copending application Ser. No. 07/360,299, filed June 2, 1989, now abandoned.

BACKGROUND OF THE INVENTION

The present invention relates generally to a tube or reservoir which provides a source of clean air for injection into a multi-dose medicament vial prior to withdrawing medicament from the vial for injection into a patient. The invention also relates to a method for loading clean-filtered air into the barrel of a syringe prior to use of the syringe to withdraw medicament from a multi-dose vial.

Liquid medication which is to be injected by needle is often sold in multi-dose containers. In some cases (e.g., insulin), as many as 50 or 60 doses or shots are contained in a single vial. The vials are fitted with a rubber diaphragm, and when a dose is to be administered, the needle of a syringe is pushed through the rubber membrane and the proper amount of liquid medicament is withdrawn for injection into the patient.

Since the vial is airtight, withdrawal of liquid medicament creates a partial vacuum inside the vial, and, after a few doses have been withdrawn, the vacuum becomes enough of a factor to make it difficult to withdraw any further doses To compensate for this, the standard practice, each time a dose is to be administered, is to inject a quantity of air into the vial first, and then withdraw the medication. As described by Sorensen et al in Basic Nursing, page 949 et seq. (W. B. Saunders Company, Philadelphia, 1979), the standard procedure includes the following steps:

1. Cleanse the stopper of the vial with alcohol or Betadine.
2. Draw into the syringe an amount of atmospheric air about equal in volume to the dose to be withdrawn from the vial.
3. Push the syringe needle through the stopper of the vial, and inject air into the vial. Then withdraw the amount of medication needed.
4. Proceed with injection of the patient.

A source of potential problems in the above standard procedure is that, if the atmospheric air should be contaminated, the contamination is incorporated in the dose of medication and is injected through the skin (normally the body's first line of defense against infection). Pathogens in the atmospheric air are thus introduced directly into the body tissues or blood, where they can cause serious infections. The problem is aggravated if the liquid medication (e.g., NPH insulin) contains suspended solids and must be shaken before the dose is withdrawn from the vial. In such case, the shaking causes the contaminated air to be thoroughly mixed with the medicament. The problem is especially aggravated after 30 or 40 shots of contaminated air have been injected into the vial.

It is an object of the present invention to provide a device and a method for overcoming the above-mentioned problems associated with the injection of atmospheric air into medicament vials.

It is a further object of the invention to provide a specially designed clean air reservoir for furnishing the air to be injected into medicament vials.

It is a still further object of the invention to provide a sequence of method steps resulting in loading a medical syringe with clean-filtered air and using such air to obtain a dose of medication for parenteral administration to patients.

Other objects and advantages will become apparent as the specification proceeds

SUMMARY OF THE INVENTION

The present invention relates to a clean air reservoir comprising a container having substantially rigid, air impermeable walls and at least two apertures, one of said apertures being sealed by an air impermeable membrane capable of penetration by the needle of a syringe, and the other aperture being sealed by a clean-filtering material.

The invention also relates to a method of administering liquid medication to a patient by injection through the skin, comprising the steps of loading air from a purified air reservoir into the barrel of a syringe, pushing the syringe needle distally through the septum of a medicament vial, expelling treated air from the barrel of the syringe into the interior of said vial, moving the syringe plunger proximally to withdraw the desired dosage of medicament from the vial, and injecting said dosage through the skin of the patient.

A preferred embodiment of the invention relates to a method of loading clean-filtered air into the barrel of a syringe, comprising the steps of pushing the syringe needle distally through a first septum of a vessel containing clean-filtered air, and moving the syringe plunger proximally to withdraw clean-filtered air from the vessel into the syringe, whereby the differential in pressure thus created within the vessel causes atmospheric air to be drawn into the vessel through a second septum fitted with a clean-filtering membrane.

BRIEF DESCRIPTION OF THE DRAWINGS

The objects, features and advantages of the invention will be apparent to those skilled in the art from the following detailed description, taken together with the accompanying drawings, in which.

DETAILED DESCRIPTION OF THE INVENTION

Figure 1:
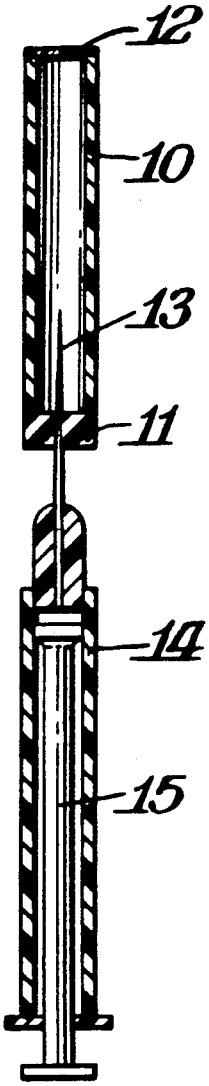
FIG. 1 is a longitudinal section of the clean air reservoir of the present invention, together with an associated syringe, prior to withdrawal of clean-filtered air from the reservoir.

Referring to the drawings, the device of the present invention is shown as a reservoir 10, having an aperture at each end. The first aperture is fitted with an air impermeable membrane or plug 11, and the second aperture is fitted with a membrane or plug 12 made of a clean-filtering material. The reservoir 10 thus comprises a container for clean air, with a septum 11 capable of being penetrated by the needle 13 of a syringe 14, and a septum 12 capable of clean-filtering atmospheric air which passes into the container when air is withdrawn from the container by the syringe.

The reservoir 10 may be in any suitable form or shape, although its preferred form is that of a cylinder or tube, with apertures at each end. The walls of the reservoir are made of any suitable air impermeable material, such as glass, acrylic resin, or the like. In the preferred embodiment, the reservoir is an acrylic tube approximately 4" in length, with an inside diameter of ½", and having a wall thickness of 1/16".

At one end, the tube 10 is fitted with an air impermeable closure 11. The preferred material for the closure is the standard rubber stopper currently used on multiple dose medicament vials. As in the case of the medicament vials, the closure 11 may comprise a rubber stopper or diaphragm, covered by a soft metal cap (e.g., aluminum), which is removed prior to use. In place of rubber, any other suitable material may be used if it is penetrable by the needle of a syringe and is self-sealing after the syringe has been removed.

At the other end, the tube 10 is fitted with a clean-filtering membrane 12. One purpose for the membrane is to act as a seal between the interior of the tube and the atmosphere when there is little or no pressure differential between the two. A further purpose is to allow atmospheric air to pass into the tube 10 when pressure is reduced in the tube and to clean-filter such air as it enters. A preferred material for the membrane is a polytetrafluoroethylene/fabric laminate sold under the trademark Gore-Tex by W. L. Gore & Associates, Inc., Newark, Del. Any suitable material comprising or incorporating a porous plastic filtering membrane such as polytetrafluoroethylene, also known as PTFE or Teflon, may be used. The pores in the membrane should be small enough to filter out dust particles and the microorganisms or pathogens associated with them, as found in the ambient air. Pores having diameters in the range from 0.1–40 μm are generally suitable for the present purpose, although membranes having pore diameters outside this range can be useful, depending on the character of the particles and the microorganisms involved. Other suitable PTFE-based materials include filter membranes sold under the trademark Ghia, by Ghia Corporation, Pleasanton, CA; and membranes sold under the mark Fluoropore, by Millipore Corporation, Bedford, Mass.

The clean air tube 10 described above, when ready for use, is initially filled with purified air. The filling may be accomplished, at the manufacturing site, by charging the tube with air which has been sterilized by chemical or heat treatment As another option, the purified air may be introduced at any time by repeatedly withdrawing air from the tube through a syringe until the air within the tube has been completely replaced by atmospheric air which has been clean-filtered by passing through the membrane 12.

In the operation of the invention, the aluminum cap is removed from the end of the clean air tube 10, exposing the rubber diaphragm 11. The outside surface of the rubber diaphragm is cleansed with an alcohol pledget, and then, as shown in FIG. 1, the needle 13 of the syringe 14 is guided distally through the rubber diaphragm 11 to position the tip of the needle well within the interior of the clean air tube 10. The relative positions of the tube 10 and the syringe 14 will then be as shown in FIG. 1, with the plunger 15 still adjacent the distal end of the syringe barrel, ready to be moved proximally to withdraw air from the clean air tube.

Figure 2:
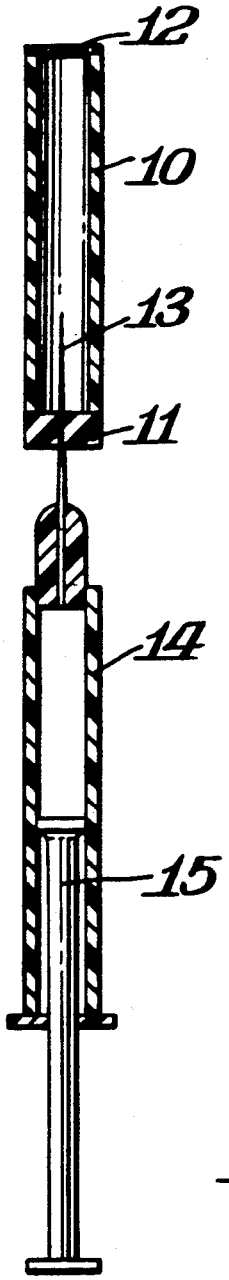
FIG. 2 is a longitudinal section of the reservoir and the syringe, after clean-filtered air has been withdrawn from the reservoir into the syringe.

As the next step, the plunger 15 is moved proximally to assume the position shown in FIG. 2. Such movement causes purified air to be withdrawn from the tube 10 and loaded into the barrel of the syringe 14. The movement of the plunger 15 should be sufficient to withdraw a volume of air substantially equal to the volume of the medicament dose to be administered to the patient. As purified air is drawn from the tube 10, the lowered pressure within the tube causes ambient air to be taken into the tube through the filter 12, as shown by the arrows in FIG. 2.

Figure 3:
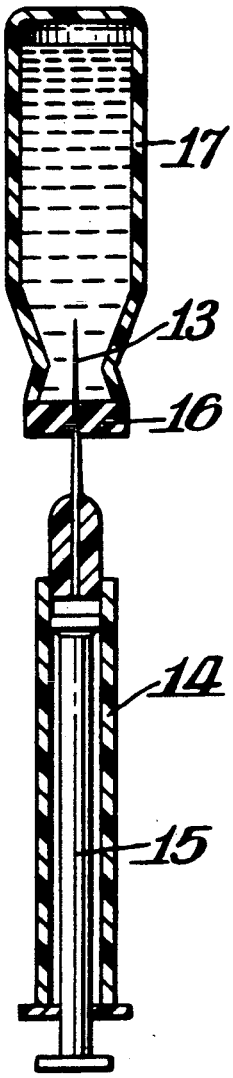
FIG. 3 is a longitudinal section of a multi-dose medicament vial and a syringe, after clean-filtered air has been injected from the syringe into the vial.

Next the outer surface of the rubber diaphragm 16 of a medicament vial 17 is cleansed with an alcohol pledget, and the needle 13 of the syringe 14 (which now contains only purified air within its barrel) is guided distally through the rubber diaphragm 16 into the interior of vial 17. The plunger 15 of the syringe is then moved distally to expel the charge of air into the interior of vial 17, thus increasing the air pressure within the vial. At this stage, the syringe 14 and the medicament vial 17 are positioned as shown in FIG. 3.

Figure 4:
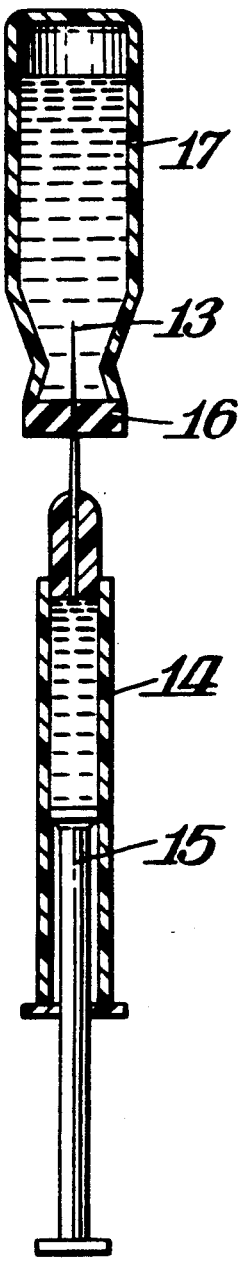
FIG. 4 is a longitudinal section of the vial and syringe, after a dose of medicament has been withdrawn from the vial into the syringe.

Finally, the plunger 15 of the syringe 14 is moved proximally to the position shown in FIG. 4, and in the course thereof a dose of liquid medicament is withdrawn from the vial 17 into the barrel of the syringe. The syringe is then removed from the vial, and the medicament is administered to the patient by injection through the skin.

The device and method of the present invention provide the following features which are significantly advantageous in terms of effectiveness, safety and economics:

1. The necessary step of injecting air into a multiple dose medicament vial prior to withdrawing the medicament can now be carried out without introducing contaminated air into the medicament.
2. The clean air tube with which this is accomplished has a simple, uncomplicated, inexpensive structure which can be mass-produced on conventional machinery.
3. Since the clean-filtered air which is withdrawn from the clean air tube is instantly replenished with freshly filtered air, the tube can be used again and again without deterioration in the purity of the air furnished.
4. The simple, light-weight structure of the clean air tube allows it to be packaged as a companion item with the medicament vial itself. The resulting tandem package thus furnishes not only the medicament but also the means for clean-filtering the air used for obtaining the medicament dose.

It will be understood that use of the term "purified" herein contemplates materials or conditions which have been treated to remove substantial proportions of microorganisms or other contaminants. Such treatment may be by means of clean-filtering or standard sterilizing techniques using heat or chemical means. The spirit of the invention would not be avoided by use of materials o conditions which have been substantially improved from the standpoint of aseptic goals, even though the theoretical goal of 100% asepsis may not have been achieved.

Although preferred embodiments of the invention have been described herein in detail, it will be understood by those skilled in the art that other variations may be made thereto without departing from the spirit of the invention.

What is claimed is:

1. A clean air reservoir comprising a container having substantial rigid, air impermeable walls and first and second apertures, said first aperture being sealed by an air impermeable membrane capable of penetration by the needle of a syringe, said impermeable membrane being self-sealing following such penetration, said second aperture being covered by an air permeable, clean-filtering microporous plastic membrane, said container initially having a charge of purified air contained within and filling the entire space between said air impermeable membrane and said microporous membrane, said purified air charge being accessible to the needle of a syringe which has penetrated said air impermeable membrane.

2. The clean air reservoir of claim 1 wherein said microporous membrane in microporous polytetrafluoroethylene.

3. The clean air reservoir of claim 1 wherein said air impermeable membrane is rubber.

4. The clean air reservoir of claim 1 wherein said container is a tube.

5. The clean air reservoir of claim 4 wherein said tube is formed of acrylic plastic.

6. The clean air reservoir of claim 4 wherein said tube is glass.

7. A method administering liquid medication to a patient by injection through the skin comprising the steps of loading purified air from a purified air reservoir into the barrel of a syringe, said syringe having accompanying barrel, syringe needle and plunger, pushing the syringe needle distally through the septum of a partially full medicament vial, expelling said purified air from the barrel of said syringe into the interior of said vial, moving the syringe plunger proximally to withdraw the desired dosage of medicament from said vial, and injecting said dosage through the skin of said patient.

8. The method of claim 7 wherein the volume of purified air expelled from the barrel of said syringe into the interior of said vial is approximately equal to the volume of medicament to be withdrawn from said vial.

9. A method of loading clean-filtered air into the barrel of a syringe, said syringe having accompanying barrel, syringe needle and plunger, comprising the steps of pushing the syringe needle distally through a first septum of a vessel containing clean-filtered air, and moving the syringe plunger proximally to withdraw said clean-filtered air from said vessel and into said syringe, whereby the differential in pressure thus created within said vessel by proximal movement of said plunger causes atmospheric air to be drawn into said vessel through a second septum of said vessel covered by a clean-filtering membrane.

10. A method of administering liquid medication to a patient by injection through the skin comprising the steps of pushing the needle of a conventional syringe having accompanying barrel, syringe needle and plunger, distally through a first septum of a container containing clean-filtered air, moving the syringe plunger proximally to withdraw clean-filtered air from said container and into said syringe, whereby the differential in pressure thus created within said container by proximal movement of said plunger causes atmospheric air to be drawn into said container through a second septum filled with an air permeable clean-filtering membrane, subsequently pushing said syringe needle distally through the septum of a partially full medicament vial, expelling clean-filtered air from the barrel of said syringe into the interior of said vial, moving the syringe plunger proximally to withdraw the desired dosage of medicament from said vial, and injecting said dosage through the skin of said patient.

* * * * *